US010107148B2

(12) United States Patent
Katsumata et al.

(10) Patent No.: US 10,107,148 B2
(45) Date of Patent: Oct. 23, 2018

(54) VALVE ROTATION DEVICE

(71) Applicant: TOYOTA JIDOSHA KABUSHIKI KAISHA, Toyota-shi, Aichi-ken (JP)

(72) Inventors: Shouji Katsumata, Gotemba (JP); Kenichi Harada, Susono (JP); Toshihisa Sugiyama, Gotemba (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 82 days.

(21) Appl. No.: 15/120,174

(22) PCT Filed: Feb. 17, 2015

(86) PCT No.: PCT/JP2015/000704
§ 371 (c)(1),
(2) Date: Aug. 19, 2016

(87) PCT Pub. No.: WO2015/125456
PCT Pub. Date: Aug. 27, 2015

(65) Prior Publication Data

US 2017/0058724 A1 Mar. 2, 2017

(30) Foreign Application Priority Data

Feb. 21, 2014 (JP) ..... 2014-032021

(51) Int. Cl.
*F01L 1/32* (2006.01)
*F01L 1/46* (2006.01)
*F01L 3/10* (2006.01)

(52) U.S. Cl.
CPC ..... *F01L 1/32* (2013.01); *F01L 1/462* (2013.01); *F01L 3/10* (2013.01)

(58) Field of Classification Search
CPC ..... F01L 1/32; F01L 1/462; F01L 3/10
USPC ..... 123/90.28, 90.29, 90.3, 90.65, 90.67
See application file for complete search history.

(56) References Cited

U.S. PATENT DOCUMENTS 2,516,795 A * 7/1950 Norton ..... F01L 1/32 123/90.3
2,767,696 A * 10/1956 Engemann ..... F01L 1/32 123/90.3
2,775,959 A * 1/1957 Geer ..... F01L 1/32 123/90.3
2,818,051 A * 12/1957 Graham ..... F01L 1/32 123/90.3

(Continued)

FOREIGN PATENT DOCUMENTS

CN 102301098 A 12/2011
DE 194 7013 A1 3/1971

(Continued)

*Primary Examiner* — Jorge Leon, Jr.
(74) *Attorney, Agent, or Firm* — Hunton Andrews Kurth LLP

(57) ABSTRACT

A valve rotation includes: a first sheet member that extends toward a surrounding of a valve stem under a condition that a rotation action of the first sheet member is suppressed with respect to a cylinder head, and a second sheet member that faces to the first sheet member, that is capable of rotating with respect to the first sheet member and is subjected to a load for opening the valve; a force conversion structure that converts the load for opening the valve applied to the second sheet member into a rotation force.

10 Claims, 15 Drawing Sheets

(56) References Cited

U.S. PATENT DOCUMENTS

| | | | | | |
|---|---|---|---|---|---|
| 2,831,469 | A * | 4/1958 | Sampietro | F01L 1/32 | 123/90.3 |
| 3,534,620 | A * | 10/1970 | Nielsen | F01L 1/32 | 123/90.29 |
| 3,717,133 | A * | 2/1973 | Enke | F01L 1/32 | 123/90.3 |
| 3,747,579 | A * | 7/1973 | Altmann | F01L 1/32 | 123/90.3 |
| 4,003,353 | A | 1/1977 | Tauschek | | |
| 4,424,773 | A * | 1/1984 | Wendel | F01L 1/32 | 123/90.29 |
| 4,538,558 | A * | 9/1985 | Updike | F01L 3/10 | 123/90.3 |
| 5,570,663 | A * | 11/1996 | Shida | F01L 1/32 | 123/188.11 |
| 6,279,526 | B1 * | 8/2001 | Strzoda | F01L 1/32 | 123/188.13 |
| 2009/0272344 | A1 * | 11/2009 | Florek | F01L 1/32 | 123/90.3 |

FOREIGN PATENT DOCUMENTS

| | | | |
|---|---|---|---|
| JP | H11-2 70314 | A | 10/1999 |
| WO | 2010-088089 | A1 | 8/2010 |

* cited by examiner

[Fig. 1]
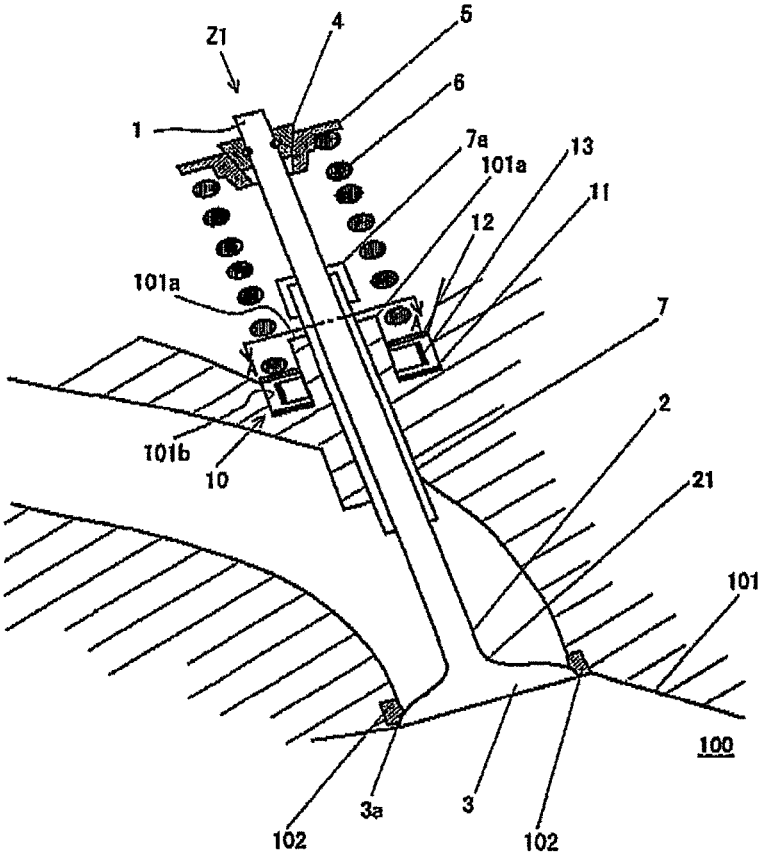

[Fig. 2]
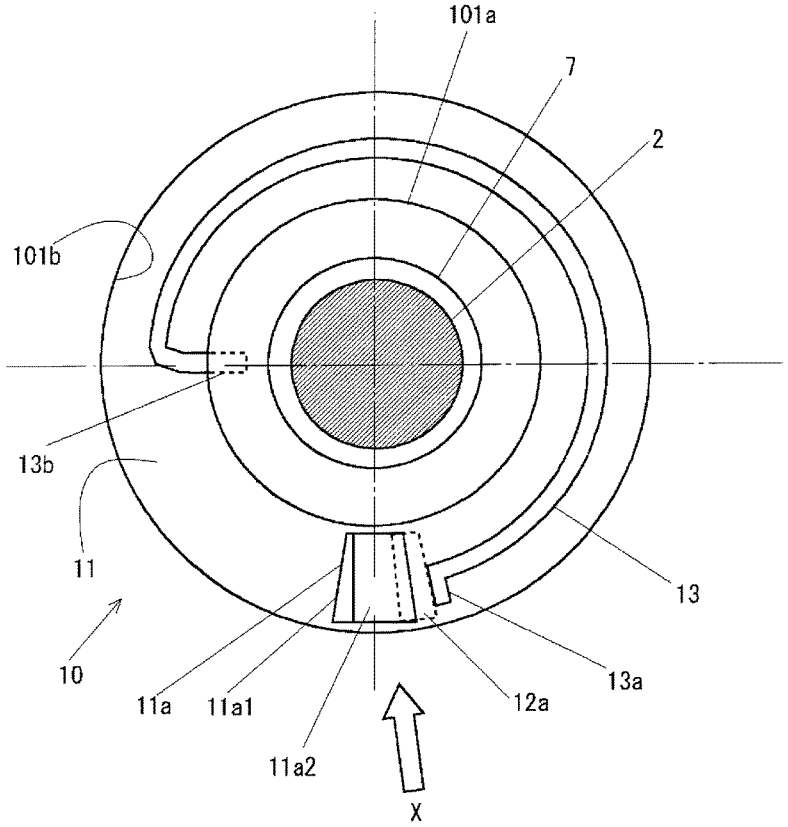

[Fig. 3]
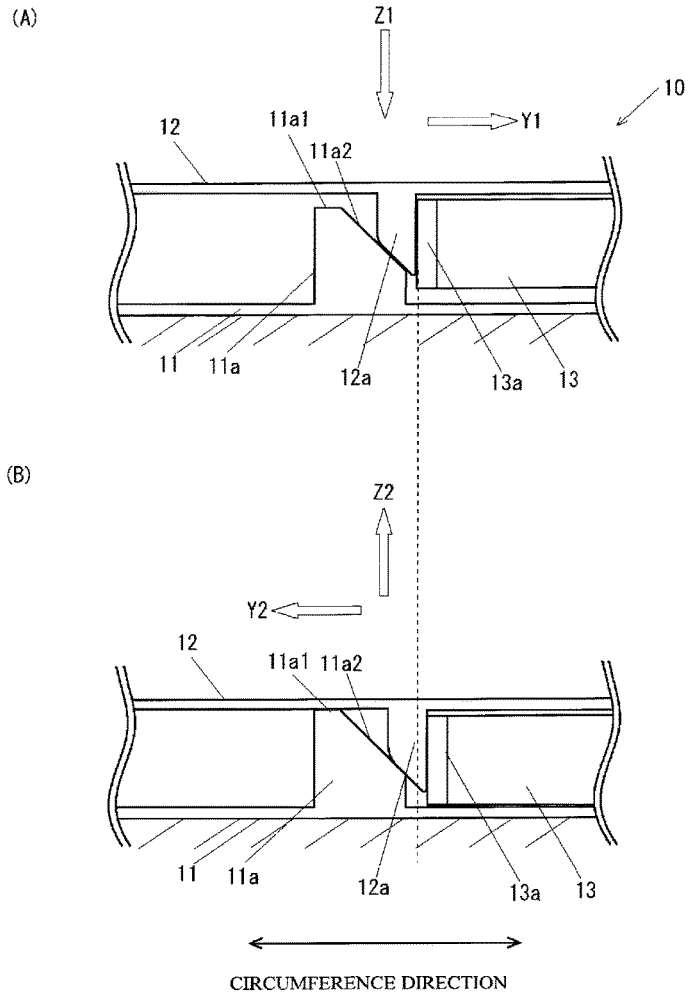

[Fig. 4]
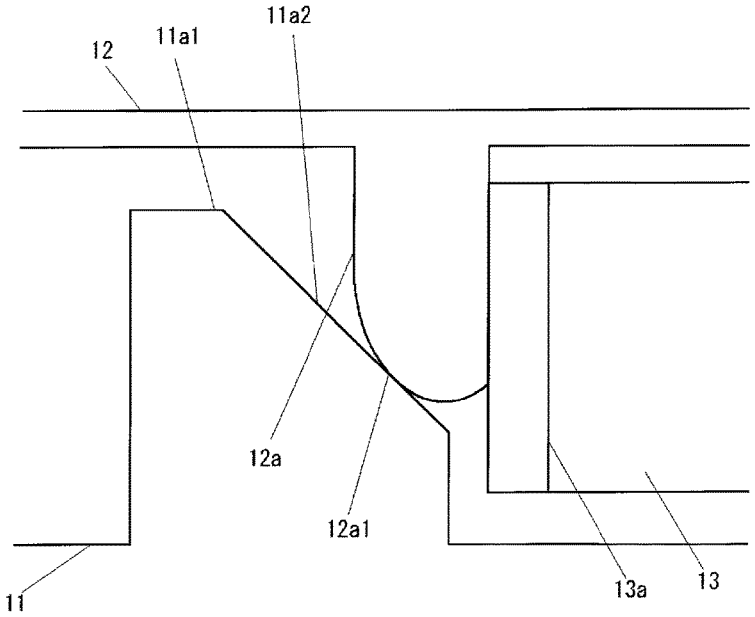

[Fig. 5]
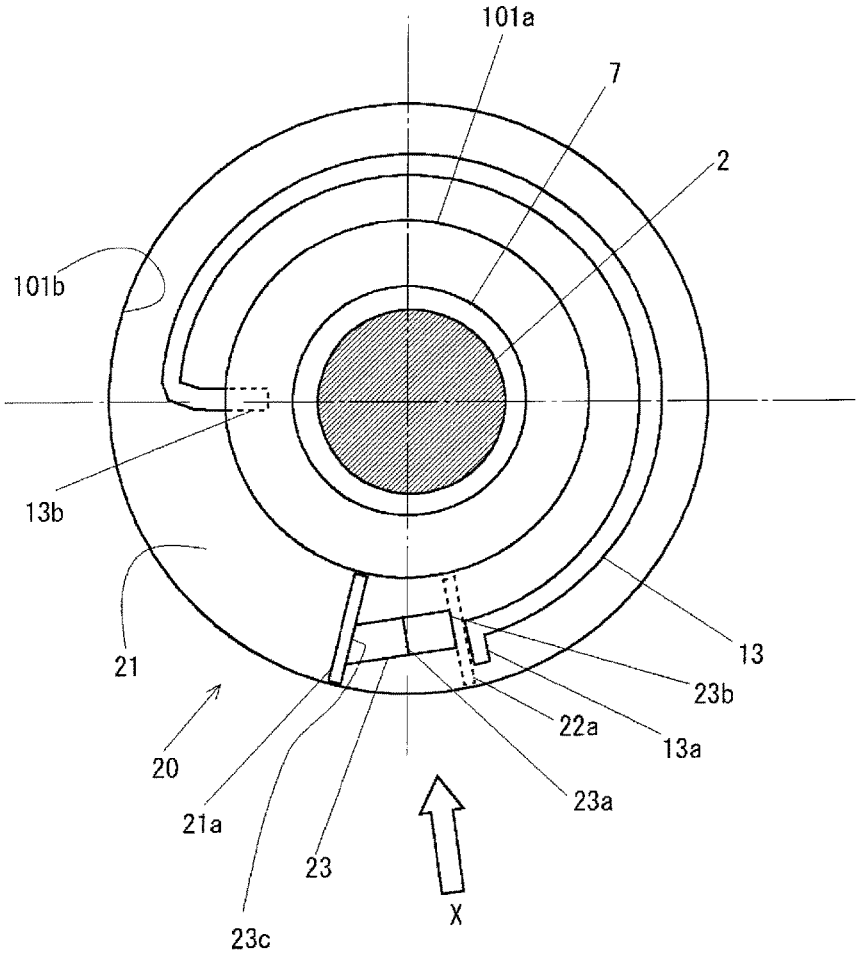

[Fig. 6]
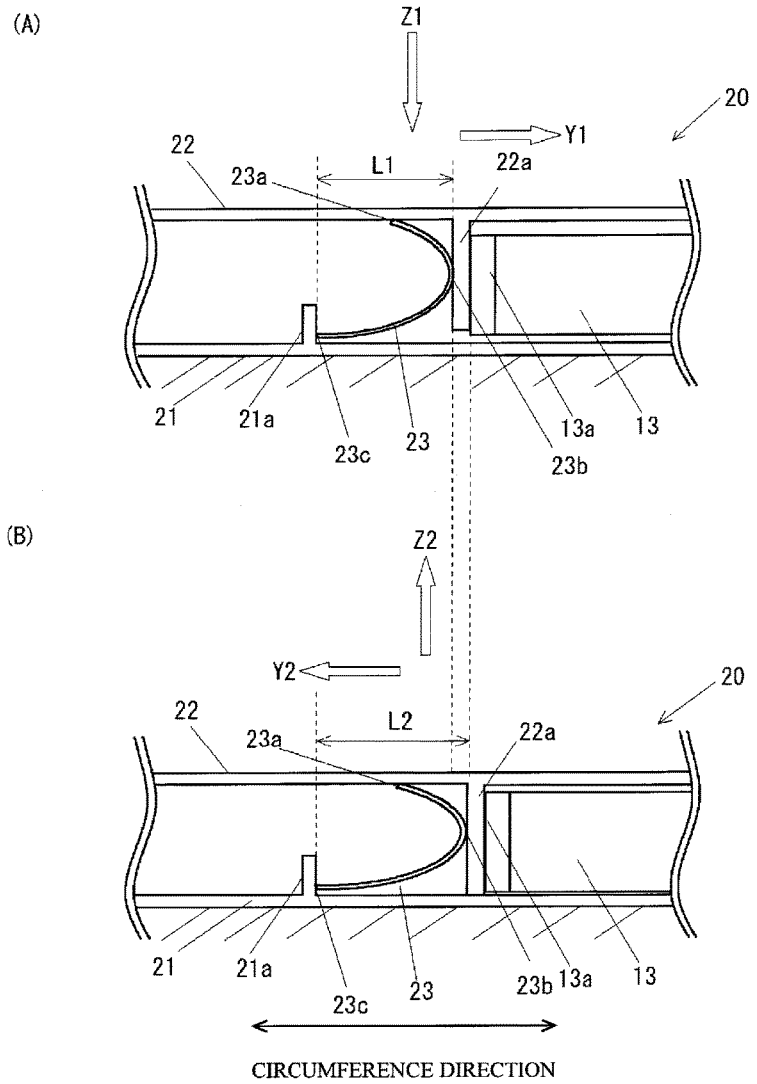

[Fig. 7]
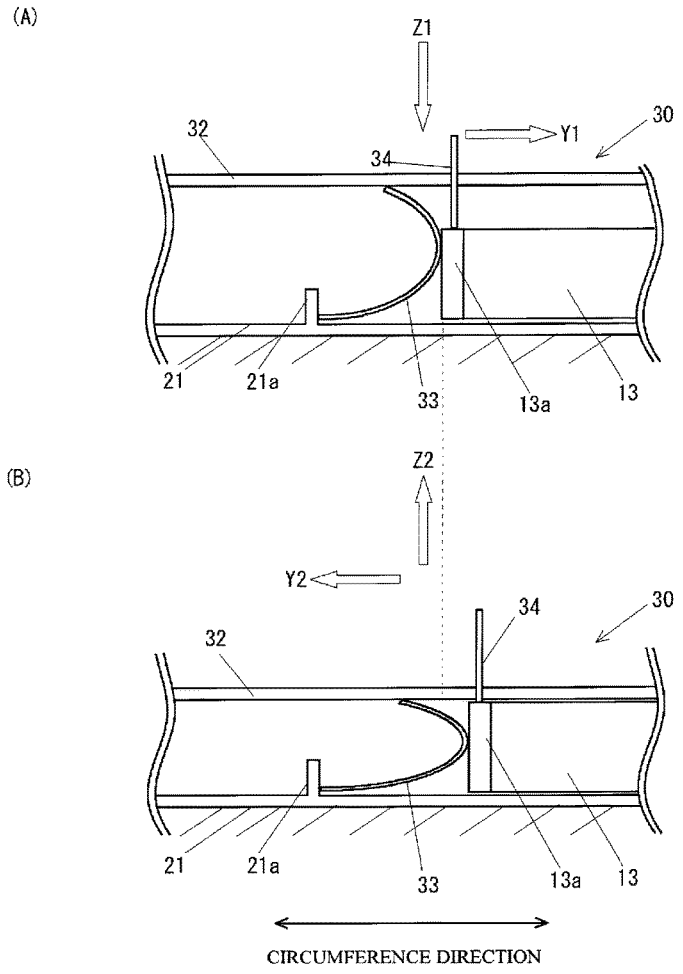

[Fig. 8]
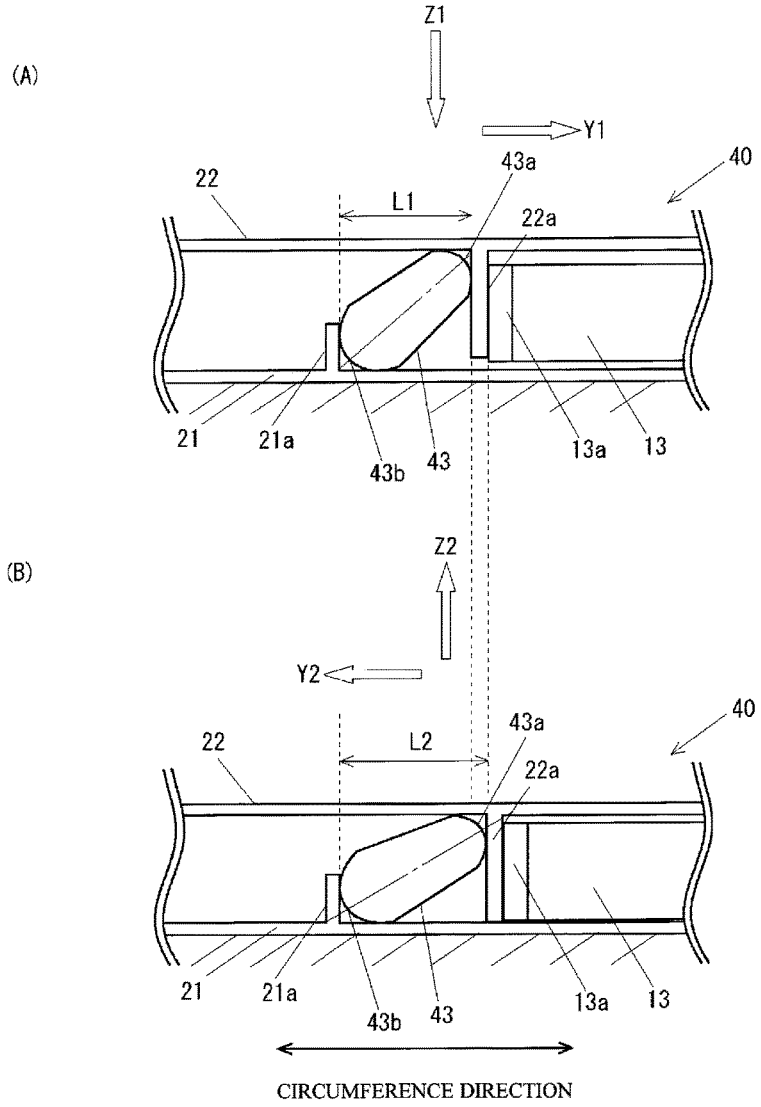

[Fig. 9]
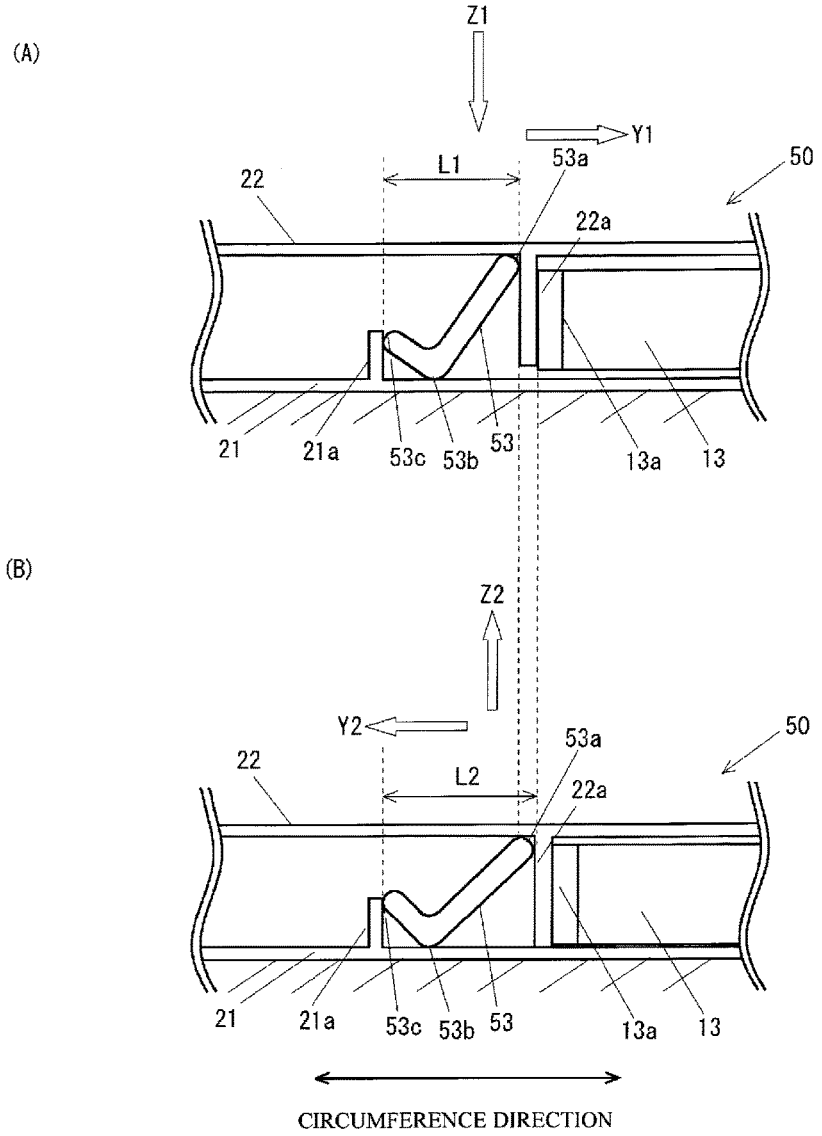

[Fig. 10]
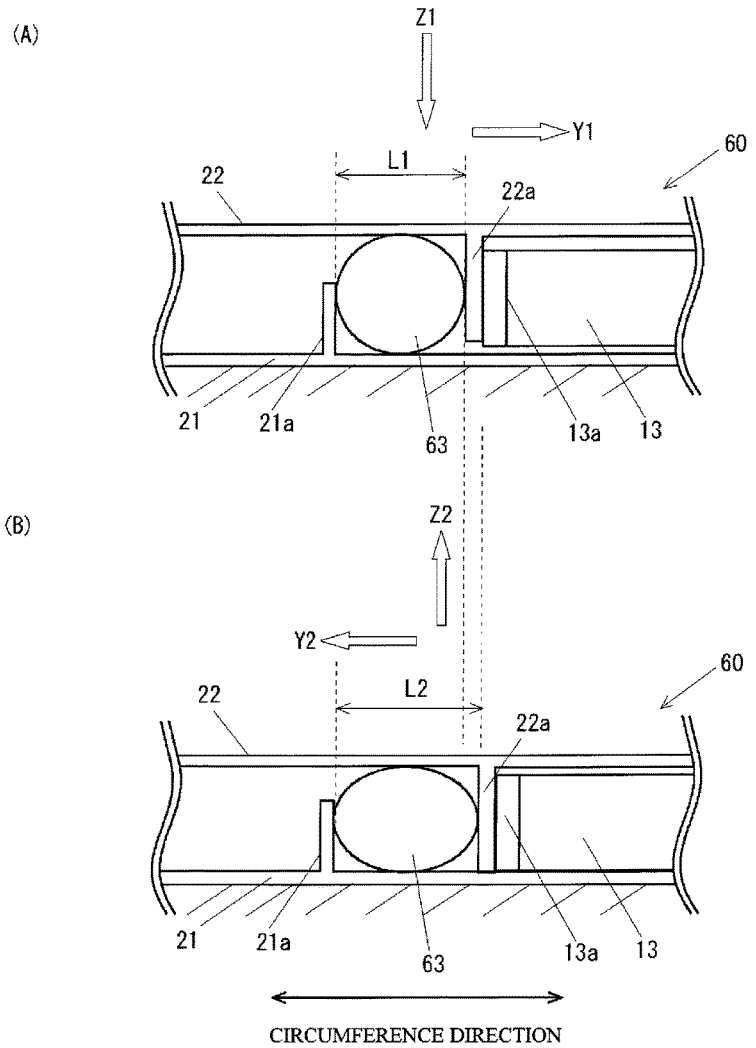

[Fig. 11]
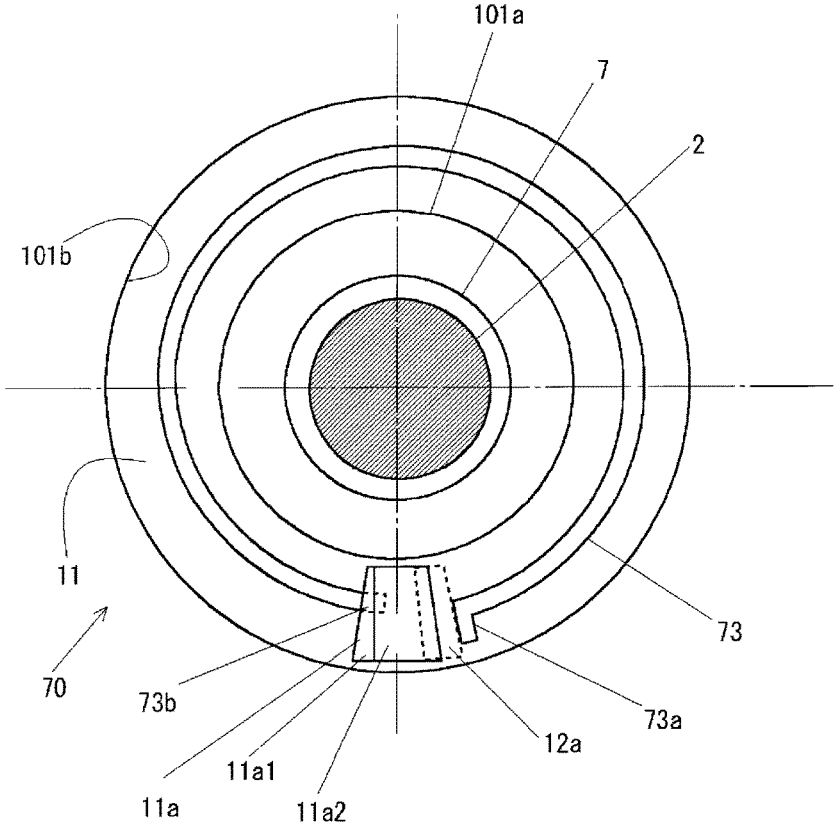

[Fig. 12]
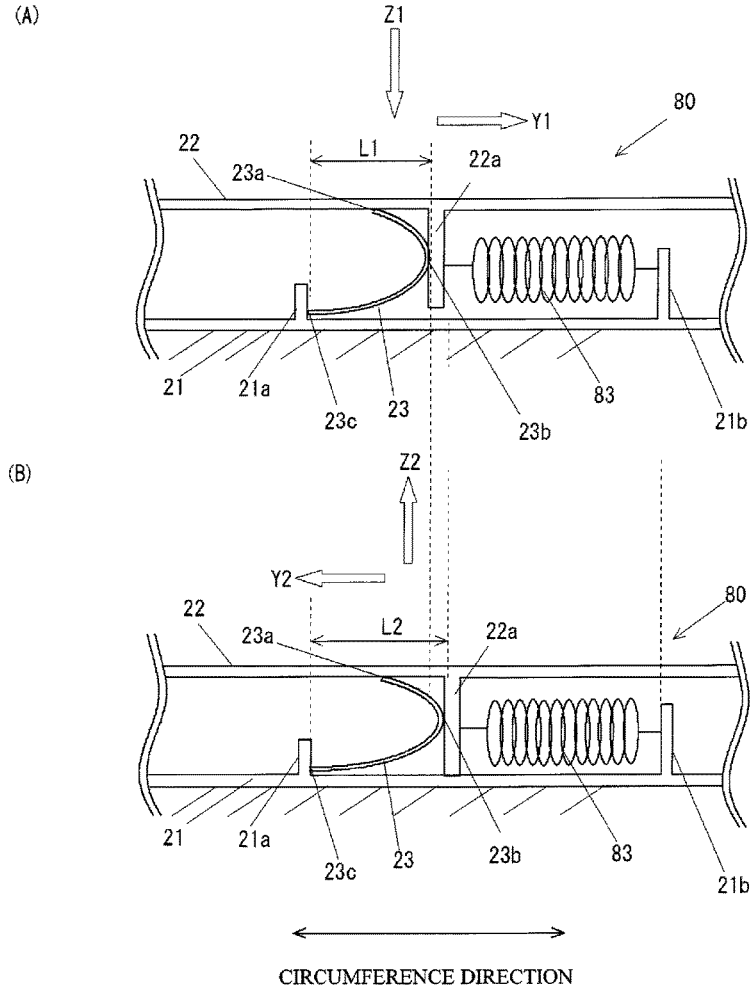

[Fig. 13]
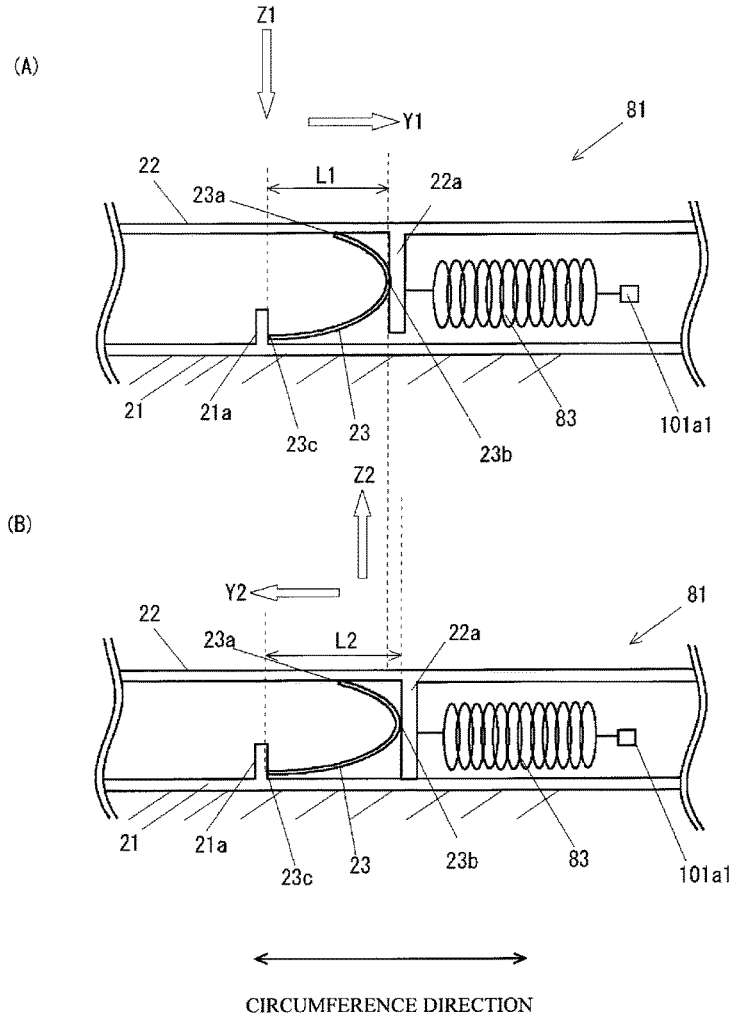

[Fig. 14]
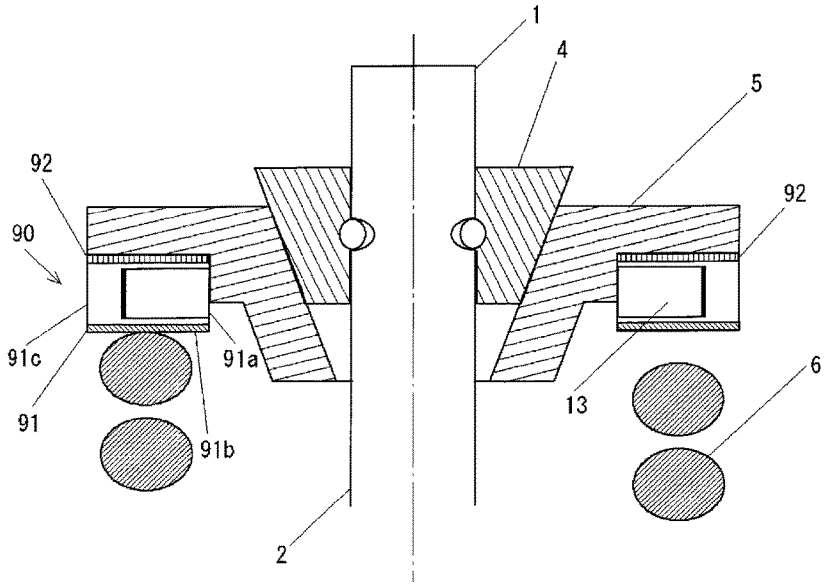

[Fig. 15]
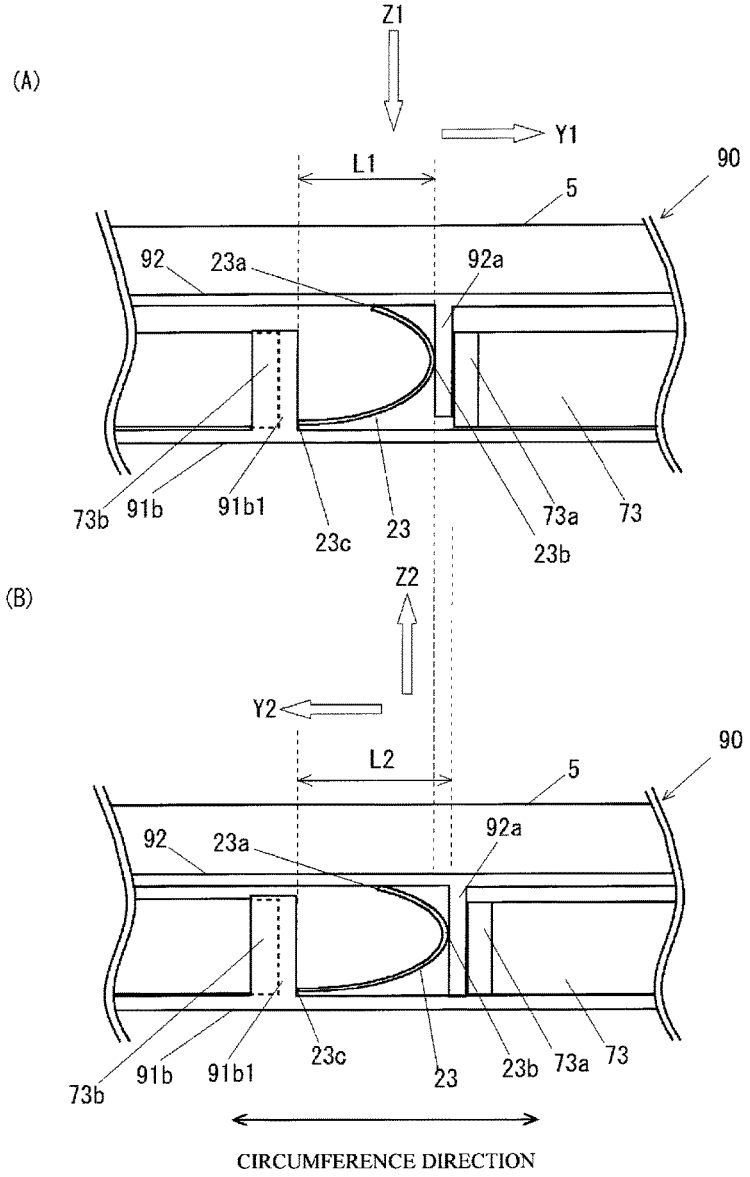

VALVE ROTATION DEVICE

CROSS-REFERENCE TO RELATED APPLICATIONS

This is a national phase application based on the PCT International Patent Application No. PCT/JP2015/000704 filed Feb. 17, 2015, claiming priority to Japanese Patent Application No. 2014-032021 filed Feb. 21, 2014, the entire contents of both of which are incorporated herein by reference.

TECHNICAL FIELD

The present invention relates to a valve rotation device.

BACKGROUND ART

An intake valve or an exhaust valve of an internal combustion engine may bite a deposit between a valve and a valve seat that are formed in a valve head. The biting of the deposit might cause compression leakage in a cylinder and accidental fire. Chewing of a deposit by rotating a valve is suggested as a countermeasure of removing a deposit that is bitten between the valve and the valve seat. A valve rotator that can be applied to the suggestion is being known (for example, with reference to Patent Document 1).

CITATION LIST

Patent Literature

PTL 1: Japanese Patent Application Publication No. 11-270314

SUMMARY OF INVENTION

Technical Problem

In a case where the deposit is bitten between the valve and the valve seat is chewed, a deposit can be chewed effectively when the valve is rotated at a timing of closing of the valve. However, although the valve rotator disclosed in Patent Document 1 forcibly rotates the valve around an axis direction of the valve rotator, the valve is rotated at a timing of opening of the valve and the rotation does not have a large effect of chewing of the deposit.

A valve rotation device disclosed in the present specification has an object to synchronize the timing of rotating of the valve with the timing of closing of the valve.

Solution to Problem

A valve rotation device that rotates a valve fixed to an internal combustion engine, includes: a first seat member that extends toward a surrounding of a valve stem of the valve under a condition that a rotation action of the first seat member is suppressed with respect to a cylinder head of the internal combustion engine; a second sea sheet member that faces to the first seat member, is capable of rotating with respect to the first sea sheet member and is subjected to a load for opening the valve; a force conversion structure that converts the load for opening the valve applied to the second seat member into a rotation force in a direction around the valve stem of the second seat member; an elastic body that accumulates an elastic energy when the valve is opened and the load for opening the valve rotates the second seat member via the force conversion structure, and rotates the second seat member by a storing force caused by the elastic energy when a phase of the valve gets closer to a valve-closed phase and the load for opening the valve is reduced, wherein the valve rotates together with the rotation of the second seat member. With the valve rotation device, it is possible to synchronize the timing of rotating of the valve with the timing of closing of the valve.

The first seat member may be arranged on the cylinder head side of the internal combustion engine. And, the second seat member may be arranged between the first seat member and the valve spring and rotates together with the valve spring. That is, the valve rotation device may be arranged on the closer side of the cylinder head.

The second seat member may be arranged on a valve retainer side and rotates together with the valve retainer. And, the first seat member may be arranged between the second seat member and the valve spring. That is, the valve rotation device may be arranged on the closer side of the valve retainer.

The valve rotation device may include a stopper portion that determines a maximum rotation amount of the second seat member that is rotated by the load for opening the valve via the force conversion structure.

The elastic body may be a spiral spring or a coil spring, a first edge of the spiral spring being connected to the second seat member, a second edge of the spiral spring being connected to the first seat member or the cylinder head of the internal combustion engine, a first edge of the coil spring being connected to the second seat member, a second edge of the coil spring being connected to the first seat member or the cylinder head of the internal combustion engine.

The force conversion structure may have a first projection portion extending toward the second seat member from the first seat member and a second projection portion extending toward the first seat member from the second seat, forms an inclined face on at least one of the first projection portion and the second projection portion, brings the first projection portion into contact with the second projection portion in along the inclined face so as to slide, rotates the second seat member with respect to the first seat member in accordance with a changing of an axial distance between the first seat member and the second seat member.

The force conversion structure may be sandwiched between the first seat member and the second seat member, has a size changeable member that changes a size of the second seat member in a direction along a circumference direction in accordance with a changing of an axial distance between the first seat member and the second sea sheet member, and rotates the second seat member with respect to the first seat member in accordance with a size changing of the size changeable member.

Advantageous Effects of Invention

According to the valve rotation device disclosed in the present specification, it is possible to synchronize a timing of rotating of a valve with a timing of closing the valve.

BRIEF DESCRIPTION OF DRAWINGS

FIG. 1 schematically illustrates a part of an internal combustion engine having a valve rotation device of a first embodiment;

FIG. 2 illustrates a cross sectional view take along a line A-A of FIG. 1 in a case where a second seat member and a valve spring are removed;

FIG. 3A and FIG. 3B illustrate a part viewed from X of FIG. 2; FIG. 3A illustrates a valve-closed phase; FIG. 3B illustrates a valve-opened phase;

FIG. 4 illustrates an enlarged view of an edge of a second projection portion;

FIG. 5 illustrates a valve rotation device in accordance with a second embodiment;

FIG. 6A and FIG. 6B illustrate a part viewed from X of FIG. 5; FIG. 6A illustrates a valve-closed phase; FIG. 6B illustrates a valve-opened phase;

FIG. 7A and FIG. 7B illustrate a part of a valve rotation device in accordance with a third embodiment; FIG. 7A illustrates a valve closed phase; FIG. 7B illustrates a valve-opened phase;

FIG. 8A and FIG. 8B illustrate a part of a valve rotation device in accordance with a fourth embodiment; FIG. 8A illustrates a valve closed phase; FIG. 8B illustrates a valve-opened phase;

FIG. 9A and FIG. 9B illustrate a part of a valve rotation device in accordance with a fifth embodiment; FIG. 9A illustrates a valve-closed phase; FIG. 9B illustrates a valve-opened phase;

FIG. 10A and FIG. 10B illustrate a part of a valve rotation device in accordance with a sixth embodiment; FIG. 10A illustrates a valve-closed phase; FIG. 10B illustrates a valve-opened phase;

FIG. 11 illustrates a valve rotation device in accordance with a seventh embodiment;

FIG. 12A and FIG. 12B illustrate a part of a valve rotation device in accordance with an eighth embodiment; FIG. 12A illustrates a valve-closed phase; FIG. 12B illustrates an valve-opened phase;

FIG. 13A and FIG. 13B illustrate a part of a valve rotation device in accordance with a modified embodiment of an eighth embodiment; FIG. 13A illustrates a valve-closed phase; FIG. 13B illustrates a valve-opened phase;

FIG. 14 illustrates a surround of a valve and a valve retainer to which a valve rotation device in accordance with a ninth embodiment is fixed;

FIG. 15A and FIG. 15B illustrate a part of a valve rotation device in accordance with a ninth embodiment; FIG. 15A illustrates a valve-closed phase; and FIG. 15B illustrates a valve-opened phase.

DESCRIPTION OF EMBODIMENTS

A description will be given of embodiments of the present invention with reference to attached drawings. However, sizes, ratios and so on of each structure may be inconsistent with an actual structures in the drawings. And, detailed structures may be omitted in some drawings.

First Embodiment

A description will be given of a valve rotation device 10 in accordance with a first embodiment with reference to FIG. 1 to FIG. 4. FIG. 1 schematically illustrates a part of an internal combustion engine 100 having the valve rotation device 10 in accordance with the first embodiment. FIG. 2 illustrates a cross sectional view taken along a line A-A of FIG. 1 in which a second seat member 12 and a valve spring 6 are removed. FIG. 3A and FIG. 3B illustrate a part of viewed from X of FIG. 2. FIG. 3A illustrates a valve-closed phase. FIG. 3B illustrates a valve-opened phase. FIG. 4 illustrates an enlarged view of an edge of a second projection portion 12*a*.

A valve 1 is fixed to the internal combustion engine 100 as an intake valve and an exhaust valve. In concrete, the valve 1 is fixed to a cylinder head 101 via a valve guide 7 supported by a valve guide boss portion 101*a* that is provided in the cylinder head 101 of the internal combustion engine 100. An oil seal 7*a* is fixed to the valve guide 7. The valve 1 has a valve head 3 on an edge side of a valve stem 2. And, the valve stem 2 is supported by the valve guide 7 so that the valve stem 2 can slide. A valve face 3*a* is formed in the valve head 3. The valve face 3*a* is in touch with the valve seat 102 provided in a port exit and makes the valve 1 close. There are some cases where a deposit is bitten between the valve face 3*a* and the valve seat 102. The valve rotation device 10 of the embodiment chews the deposit between the valve face 3*a* and the valve seat 102.

A valve retainer 5 that is attached by a cotter 4 is fixed to a base end of the valve 1, that is, an edge which is an opposite of the valve head 3. The valve spring 6 is sandwiched between the valve retainer 5 and the second seat member 12 described later. Here, the cotter 4 is fixed to the valve stem 2 so that the cotter 4 does not slide with respect to the valve stem 2. The valve spring 6 is set so as to have an elastic force widening an interval between the valve retainer 5 and the second seat member 12. And, the valve spring 6 has an elastic force making an outer circumference face of the cotter 4 and an inner circumference face of the valve retainer 5 stick together. The elastic force of the valve spring 6 fixes the valve retainer 5 to the valve spring 6. Thereby, the valve 1 and the valve spring 6 rotate together. Thereby, the valve 1 and the valve spring 6 rotate together.

The valve rotation device 10 of the embodiment rotates the valve 1 fixed to the cylinder head 101 together with the valve spring 6. In this point, the valve rotation device 10 is different from what is called a free valve in which friction force between a cotter and a valve stem is weak and the valve can freely rotate separately from a valve spring.

The valve rotation device 10 rotating the valve 1 with the valve spring 6 has a first seat member 11 and the second seat member 12. The first seat member 11 of the valve rotation device 10 of the embodiment is arranged on the cylinder head 101 side of the internal combustion engine. The second seat member 12 is arranged between the first sea sheet member 11 and the valve spring 6, and rotates with the valve spring 6.

The first seat member 11 is a member arranged so as to extend toward a surrounding of the valve stem 2 of the valve 1 under a condition that the rotation operation action of the first seat member 11 is suppressed with respect to the cylinder head 101 of the internal combustion engine. In concrete, the first seat member 11 is fixed in a concave portion 101*b* that is circularly provided around the valve guide boss portion 101*a* of the cylinder head 101. Thereby, the rotation of the first seat member 11 is suppressed with respect to the cylinder head 101. The second seat member 12 faces to the first seat member 11. The second seat member 12 can rotate with respect to the first seat member 11 and receives a load for opening the valve 1. The load for opening the valve 1 is applied to the second seat member 12 via the valve spring 6. That is, the second seat member 12 of the valve rotation device 10 is in touch with the valve spring 6 and acts as a spring sheet. The second seat member 12 can rotate not only with the valve spring 6 but also with the valve 1.

A first projection portion 11*a* extending toward the second seat member 12 is provided on the face of the first seat member 11 facing with the second seat member 12. The second projection portion 12*a* extending toward the first seat member 11 is provided on the face of the second seat member 12 facing with the first seat member 11. A combination of the first projection portion 11*a* and the second projection portion 12*a* acts as a force conversion structure that converts the load for opening the valve 1 that is received by the second seat member 12 into a rotative force around the valve stem 2 of the second seat member 12, that is, a circumference direction. With reference to FIG. 3A and FIG. 3B, the first projection portion 11*a* has a top face 11*a*1 and an inclined face 11*a*2. An edge portion 12*a*1 of the second projection portion 12*a* is in touch with the inclined face 11*a*2 and is capable of sliding. With reference to FIG. 4, the edge portion 12*a*1 of the second projection portion 12*a* is subjected to a curving process so as to project downward. Thereby, a line contact between the edge portion 12*a*1 of the second projection portion 12*a* and the inclined face 11*a*2 is achieved. Thus, the friction is suppressed. And, the edge portion 12*a*1 can slide smoothly on the inclined face 11*a*2. In accordance with the condition of the valve 1, a distance between the first seat member 11 and the second seat member 12 changes. That is, when the valve 1 is opened, the valve spring 6 is shortened and the second seat member 12 is pressed. Thereby, the distance between the first seat member 11 and the second seat member 12 is reduced. On the other hand, when the phase of the valve 1 gets closer to the valve-closed phase, the distance between the first seat member 11 and the second seat member 12 is enlarged by a restoring force caused by the elastic energy accumulated by a spiral spring 13 described later. The valve rotation device 10 rotates the second seat member 12 with respect to the first seat member 11 in accordance with the changing of the distance between the first seat member 11 and the second seat member 12.

The valve rotation device 10 has the spiral spring 13 that is an example of an elastic body. The spiral spring 13 accumulates the elastic energy when the valve 1 is opened and the second seat member 12 rotates via the combination of the first projection portion 11*a* and the second projection portion 12*a* by the load for opening the valve 1. And, the spiral spring 13 rotates the second seat member 12 with use of the restoring force thereof accumulated when the phase of the valve 1 gets closer to the valve-closed phase and the load for opening the valve 1 is decreased.

The spiral spring 13 has a chin-shaped portion 13*a* on one edge side. The spiral spring 13 brings the chin-shaped portion 13*a* into contact with the second projection portion 12*a*, and thereby the spiral spring 13 is connected to the second seat member 12. The spiral spring 13 has an engagement portion 13*b* on the other edge side. The spiral spring 13 fixes the engagement portion 13*b* to the cylinder head 101, and thereby the spiral spring 13 is connected to the cylinder head 101.

With reference to FIG. 3A and FIG. 3B, when the second seat member 12 is subjected to a load as indicated by an arrow Z1 during opening of the valve 1, the second projection portion 12*a* descends along the inclined face 11*a*2. Thereby, the second seat member 12 rotates in a direction indicated by an arrow Y1. In this case, when the spiral spring 13 is pressed, the spiral spring 13 accumulates the elastic energy. And, when the phase of the valve 1 gets closer to the valve-closed phase and the force for opening the valve 1 indicated by an arrow Z2 is reduced, the restoring force caused by the elastic energy accumulated by the spiral spring 13 rotates the second seat member 12 in a direction indicated by an arrow Y2. When the second seat member 12 rotates, the valve spring 6, the valve retainer 5, the cotter 4 and the valve 1 rotate in the direction indicated by the arrow Y2. In this manner, in the valve rotation device 10 of the embodiment, the valve 1 rotates when the phase of the valve 1 gets closer to the valve-closed phase. Thus, with the rotating of the valve 1, the deposit can be chewed between the valve seat 102 and the valve face 3*a*. That is, the valve face 3*a* rotates under a condition that an interval between the valve seat 102 and the valve face 3*a* is reduced. Therefore, the deposit is subjected to an operation like grinding. And, the deposit is effectively chewed.

In the valve rotation device 10 of the embodiment, the first projection portion 11*a* acts as a stopper portion. That is, the first projection portion 11*a* determines a maximum rotation amount of the second seat member 12 that rotates via the second projection portion 12*a* due to the load for opening the valve 1. When the second seat member 12 is pressed by the load for opening the valve 1 via the valve spring 6 and the second seat member 12 gets closer to the first seat member 11, the top face 11*a*1 of the first projection portion 11*a* gets in touch with the second seat member 12. When the top face 11*a*1 gets in touch with the second seat member 12, declining more of the second seat member 12 is suppressed. And, the rotation of the second seat member 12 in the arrow Y1 is also suppressed. The rotation amount of the second seat member 12 has a correlation with the declining amount of the second seat member 12. Therefore, when the first projection portion 11*a* acts as the stopper portion and the declining amount of the second seat member 12 is determined, the maximum rotation amount of the second seat member 12 can be determined. When the rotation amount of the second seat member 12 is determined, the maximum rotation amount of the valve 1 is determined. When the maximum rotation amount of the valve 1 is determined in this manner, excessive friction (abnormal friction) between the valve face 3*a* and the valve seat 102 can be suppressed. A height of the first projection portion 11*a* acting as the stopper portion can be arbitrarily changed in accordance with the necessary maximum rotation amount of the valve.

As mentioned above, with the valve rotation device 10 of the embodiment, the timing of the rotation of the valve 1 can be synchronized with the timing of the closing of the valve 1. And, the deposit can be effectively chewed. And, with the valve rotation device 10 of the embodiment, the deposit can be chewed between the valve seat 102 and the valve face 3*a* in spite of the rotation number of the internal combustion engine 100. And, the valve 1 never freely rotates. And, the rotation amount of the valve 1 is a rotation amount determined by the compression amount of the spiral spring 13 or the maximum rotation amount of the second seat member 12. Therefore, the abnormal friction of the valve seat 102 can be suppressed.

Second Embodiment

Next, a description will be given of a valve rotation device 20 in accordance with a second embodiment with reference to FIG. 5, FIG. 6A and FIG. 6B. FIG. 5 illustrates the valve rotation device 20 of the second embodiment. FIG. 6A and FIG. 6B illustrate a part viewed from the X of FIG. 5. FIG. 6A illustrates a valve-closed phase. FIG. 6B illustrates a valve-opened phase. The valve rotation device 20 of the second embodiment is different from the valve rotation device 10 of the first embodiment in a point of a force conversion structure. In the valve rotation device 10, a combination of the first projection portion 11*a* and the second projection portion 12*a* acts as the force conversion structure. In contrast, in the valve rotation device 20 of the second embodiment, a combination of the first projection portion 21*a* provided in a first seat member 21, a second projection portion 22*a* provided in a second seat member 22, and a bent spring 23 acts as the force conversion structure. Hereinafter, a description will be given of a difference point between the first embodiment and the second embodiment. The same reference numerals are added to components that are common with the first embodiment in drawings. Detailed explanation is omitted.

The first seat member 21 is arranged so as to extend toward the surrounding of the valve stem 2 of the valve 1 under a condition that the rotation action is suppressed with respect to the cylinder head 101, as well as the first seat member 11 of the first embodiment. The first projection portion 21*a* extending to the second seat member 22 is provided on a face of the first seat member 21 facing with the second seat member 22. The second projection portion 22*a* extending to the first seat member 21 is provided on a face of the second seat member 22 facing with the first seat member 21. The spiral spring 13 is connected to the second seat member 22 as well as the first embodiment.

With reference to FIG. 5, FIG. 6A and FIG. 6B, the bent spring 23 is formed in which a board material is bent and acts as a spring. The bent spring 23 has an upper edge portion 23*a*, a bent top portion 23*b* and a lower edge portion 23*c*. The bent spring 23 is sandwiched between the first seat member 21 and the second seat member 22. The bent spring 23 is an example of a size-changeable member that changes a size of the second seat member 22 in a direction along the circumference direction of the second seat member 22 when a distance between the first seat member 21 and the second seat member 22 is changed. The bent spring 23 is sandwiched between the first seat member 21 and the second seat member 22. In concrete, the bent spring 23 brings the upper edge portion 23*a* into contact with the second seat member 22, engages the lower edge portion 23*c* with the first projection portion 21*a* of the first seat member 21, and is sandwiched between the first seat member 21 and the second seat member 22. The bent top portion 23*b* is in touch with the second projection portion 22*a*. With reference to FIG. 6A, in a case of the valve-closed phase, that is, when the load for opening the valve 1 is not applied, the size of the bent spring 23 in a direction along the circumference direction of the second seat member 22 is L1. From the condition, the load for opening the valve 1 is applied to the second seat member 22. When the first seat member 21 gets closer to the second seat member 22, the size of the bent spring 23 in the direction along the circumference direction of the second seat member 22 is L2. L1 is less than L2 (L1<L2). The spiral spring 13 is pressed by a difference between the size L1 and the size L2. And, the elastic energy is accumulated.

That is, when a load is applied to the second seat member 22 as indicated by the arrow Z1 in the valve-opening of the valve 1, the size L1 of the bent spring 23 is changed into the size L2, and the second seat member 22 rotates in a direction indicated by the arrow Y1. In this case, when the spiral spring 13 is pressed, the spiral spring 13 accumulates the elastic energy. And, when the phase of the valve 1 gets closer to the valve-closed phase and the force for opening the valve 1 is reduced as indicated by the arrow Z2, a restoring force caused by the elastic energy accumulated by the spiral spring 13 rotates the second seat member 22 in the direction indicated by the arrow Y2. As the second seat member 22 rotates, the valve spring 6, the valve retainer 5, the cotter 4 and the valve 1 rotate in the direction indicated by the arrow Y2. In this manner, in the valve rotation device 20 of the second embodiment, the deposit can be chewed between the valve seat 102 and the valve face 3*a* with the valve 1 being rotated, as well as the valve rotation device 10 of the first embodiment.

In the second embodiment, the second projection portion 22*a* acts as the stopper portion. That is, when the first seat member 21 gets closer to the second seat member 22, the maximum rotation amount of the second seat member 22 is determined by the contacting of the second projection portion 22*a* to the first seat member 21.

Third Embodiment

Next, with reference to FIG. 7A and FIG. 7B, a description will be given of a valve rotation device 30 in accordance with a third embodiment. FIG. 7A and FIG. 7B illustrate a part of the valve rotation device 30 of the third embodiment. FIG. 7A illustrates a valve-closed phase. FIG. 7B illustrates a valve-opened phase. The valve rotation device 30 of the third embodiment is different from the valve rotation device 20 of the second embodiment in a point that the valve rotation device 30 of the third embodiment does not have a portion acting as a stopper portion. That is, the valve rotation device 30 of the third embodiment does not have a portion corresponding to the second projection portion 22*a*. Hereinafter, a description will be mainly given of the difference point from the second embodiment. The same reference numerals are added to components that are common with the second embodiment in drawings. Detailed explanation is omitted.

With reference to FIG. 7A, the distance between the first seat member 21 and a second seat member 32 in a case where the load for opening the valve 1 is not applied and the valve 1 is closed is larger than that of the second embodiment such that either the first seat member 21 and the second seat member 32 does not interfere the spiral spring 13 even if the maximum load is applied as illustrated in FIG. 7B and declination amount of the second seat member 32 is maximum. Therefore, the size of a bent spring 33 is larger than that of the bent spring 23 of the second embodiment. The valve rotation device 30 does not have a portion corresponding to the second projection portion 22*a*. The valve rotation device 30 has a bar-shaped member 34 instead of the second projection portion 22*a*. In the second embodiment, the second projection portion 22*a* acts as a portion connected to the spiral spring 13. The spiral spring 13 is pressed via the second projection portion 22*a*. When the restoring force of the spiral spring 13 rotates the second seat member 22, the second seat member 22 is pressed by the spiral spring 13 via the second projection portion 22*a*. In contrast, in the valve rotation device 30 of the third embodiment, a force is conducted between the spiral spring 13 and the second seat member 22 via the bar-shaped member 34. The bar-shaped member 34 stands on the chin-shaped portion 13*a* of the spiral spring 13. The bar-shaped member 34 penetrates a through hole formed in the second seat member 22 and is engaged with the bar-shaped member 34.

In this manner, the valve rotation device 30, in which the bar-shaped member 34 is used instead of the second projection portion 22*a*, rotates the valve 1 as well as the valve rotation device 20 of the second embodiment and is capable of chewing the deposit between the valve seat 102 and the valve face 3*a*.

Fourth Embodiment

Next, a description will be given of a valve rotation device 40 in accordance with a fourth embodiment with reference to FIG. 8A and FIG. 8B. FIG. 8A and FIG. 8B illustrate a part of the valve rotation device 40 in accordance with the fourth embodiment. FIG. 8A illustrates a valve-closed phase. FIG. 8B illustrates a valve-opened phase. The valve rotation device 40 of the fourth embodiment is different from the valve rotation device 20 of the second embodiment in a point of a force conversion structure. In the valve rotation device 20, a combination of the first projection portion has provided in the first seat member 21, the second projection portion 22*a* provided in the second seat member 22, and the bent spring 23 act as the force conversion structure. In contrast, in the valve rotation device 40, a cam member 43 is used instead of the bent spring 23. In the following, a description will be given of a difference from the second embodiment. The same reference numerals are added to components that are common with the second embodiment in drawings. Detailed explanation is omitted.

The bent spring 23 of the second embodiment is used as an example of the size changeable member. In the fourth embodiment, the cam member 43 is adopted instead of the bent spring 23. The cam member 43 has a top portion 43*a* and a bottom portion 43*b* that have a substantially half circular shape. In comparison between the top portion 43*a* and the bottom portion 43*b*, a diameter of the bottom portion 43*b* is larger than that of the bottom portion 43*b*. The cam member 43 is sandwiched between the first seat member 21 and the second seat member 22. In concrete, in the cam member 43, the bottom portion 43*b* is in touch with the first seat member 21 and the first projection portion 21*a*. And, the top portion 43*a* is sandwiched between the first seat member 21 and the second seat member 22 so as to be in touch with the second seat member 22 and the second projection portion 22*a*. With reference to FIG. 8A, in the valve-closed phase, that is, when the load for opening the valve 1 is not applied, the size of the cam member 43 in the circumference direction of the second seat member 22 is L1. From the phase, the load for opening the valve 1 is applied to the second seat member 22. When the first seat member 21 gets closer to the second sea sheet member 22, the size of the cam member 43 in the circumference direction of the second seat member 22 is L2. Here, L1 is less than L2 (L1<L2). The spiral spring 13 is pressed by the difference between the size L1 and the size L2. And, the elastic energy is accumulated.

That is, in a case where the load is applied to the second seat member 22 as indicated by the arrow Z1 when the valve is opened, the size L1 of the cam member 43 is changed to the size L2 and the second seat member 22 rotates in the direction indicated by the arrow Y1. That is, when the spiral spring 13 is pressed, the spiral spring 13 accumulates the elastic energy. And, when the phase of the valve 1 gets closer to the valve-closed phase and the force for opening the valve 1 is reduced as indicated by the arrow Z2, the storing force caused by the elastic energy accumulated by the spiral spring 13 rotates the second seat member 22 in the direction indicated by the arrow Y2. As the second seat member 22 rotates, the valve spring 6, the valve retainer 5, the cotter 4 and the valve 1 rotate in the direction indicated by the arrow Y2. In this manner, the valve rotation device 40 of the fourth embodiment can chew the deposit between the valve seat 102 and the valve face 3*a* with the valve 1 being rotated, as well as the valve rotation device 20 of the second embodiment.

Fifth Embodiment

Next, a description will be given of a valve rotation device 50 in accordance with a fifth embodiment with reference to FIG. 9A and FIG. 9B. FIG. 9A and FIG. 9B illustrate a part of the valve rotation device 50 in accordance with the fifth embodiment. FIG. 9A illustrates a valve-closed phase. FIG. 9B illustrates a valve-opened phase. The valve rotation device 50 of the fifth embodiment is different from the valve rotation device 40 of the fourth embodiment in a point that a bent cam member 53 is used as the size-changeable member instead of the cam member 43.

The bent cam member 53 has a long portion 53*a*, a bent portion 53*b* and a short portion 53*c*. The bent cam member 53 is sandwiched between the first seat member 21 and the second seat member 22. In concrete, an edge portion of the short portion 53*c* is in touch with the first projection portion 21*a*. And, the bent portion 53*b* is in touch with the first seat member 21. The long portion 53*a* is in touch with the second seat member 22 and the second projection portion 22*a*. The bent cam member 53 is sandwiched between the first seat member 21 and the second seat member 22 in this manner. With reference to FIG. 9A, in the valve-closed phase, that is, when the load for opening the valve 1 is not applied, the size of the bent cam member 53 in the circumference direction of the second seat member 22 is L1. From the phase, when the load for opening the valve 1 is applied to the second seat member 22 and the first seat member 21 gets closer to the second seat member 22, the size of the bent cam member 53 in the direction along the circumference direction of the second seat member 22 is L2. Here, L1 is less than L2 (L1<L2). The spiral spring is pressed by the difference between the size L1 and the size L2. And, the elastic energy is accumulated.

That is, in a case where the load is applied to the second seat member 22 as indicated by the arrow Z1 when the valve 1 is opened, the size L1 of the bent cam member 53 is changed into the size L2 and the second seat member 22 rotates in the direction indicated by the arrow Y1. In this case, the spiral spring 13 is pressed. Thereby, the spiral spring 13 accumulates the elastic energy. And, when the phase of the valve 1 gets closer to the valve-closed phase and the force for opening the valve 1 is reduced as indicated by the arrow Z2, the storing force caused by the elastic energy accumulated by the spiral spring 13 rotates the second seat member 22 in the direction indicated by the arrow Y2. As the second seat member 22 rotates, the valve spring 6, the valve retainer 5, the cotter 4 and the valve 1 rotate in the direction indicated by the arrow Y2. In this manner, the valve rotation device 50 of the fifth embodiment can chew the deposit between the valve seat 102 and the valve face 3*a* with the valve 1 being rotated, as well as the valve rotation device 40 of the fourth embodiment.

Sixth Embodiment

Next, a description will be given of a valve rotation device 60, with reference to FIG. 10A and FIG. 10B. FIG. 10A and FIG. 10B illustrate a part of the valve rotation device 60 in accordance with the sixth embodiment. FIG. 10A illustrates a valve-closed phase. FIG. 10B illustrates a valve-opened phase. The valve rotation device 60 of the sixth embodiment is different from the valve rotation device 20 of the second embodiment in a point that a spherical member 63 is used as a size-changeable member instead of the bent spring 23.

The spherical member 63 is a member that is made of a rubber material having elastic property and is formed into a spherical shape. When the spherical member 63 is compressed, the size of the spherical member 63 in a direction different from the compression direction is enlarged. The spherical member 63 is sandwiched between the first seat member 21 and the second seat member 22. In concrete, the spherical member 63 is housed in a region surrounded by the first seat member 21, the first projection portion 21*a*, the second seat member 22 and the second projection portion 22*a*. With reference to FIG. 10A, in the valve-closed phase, that is, when the load for opening the valve 1 is not applied, the size of the spherical member 63 in the direction along the circumference direction of the second seat member 22 is L1. When the load for opening the valve 1 is applied to the second sea sheet member 22 and the first seat member 21 gets closer to the second sea sheet member 22 from the phase, the size of the spherical member 63 in the direction along the circumference direction of the second seat member 22 is L2. Here, L1 is less than L2 (L1<L2). The spiral spring 13 is pressed by the difference between the size L1 and the size L2. And the elastic energy is accumulated.

That is, in a case where the load is applied to the second seat member 22 as indicated by the arrow Z1 when the valve 1 is opened, the size L1 of the spherical member 63 is changed into the size L2. And, the second seat member 22 rotates in the direction indicated by the arrow Y1. In this case, when the spiral spring 13 is pressed, the spiral spring 13 accumulates the elastic energy. When the phase of the valve 1 gets closer to the valve-closed phase and the force for opening the valve 1 is reduced as indicated by the arrow Z2, the storing force caused by the elastic energy accumulated by the spiral spring 13 rotates the second seat member 22 in the direction indicated by the arrow Y2. As the second seat member 22 rotates, the valve spring 6, the valve retainer 5, the cotter 4 and the valve 1 rotate in the direction indicated by the arrow Y2. In this manner, the valve rotation device 60 of the sixth embodiment can chew the deposit between the valve seat 102 and the valve face 3*a* with the valve 1 being rotated, as well as the valve rotation device 20 of the second embodiment.

Seventh Embodiment

Next, a description will be given of a valve rotation device 70 in accordance with a seventh embodiment with reference to FIG. 11. FIG. 11 illustrates the valve rotation device 70 in accordance with the seventh embodiment. The phase illustrated in FIG. 11 corresponds to FIG. 2 of the first embodiment. The valve rotation device 70 of the seventh embodiment is different from other embodiments in a point that a spiral spring 73 is used instead of the spiral spring 13 of the other embodiments. The spiral spring 73 has a chin-shaped member 73*a* on a first edge portion thereof as well as the spiral spring 13. The spiral spring 73 is connected to the second projection portion 12*a* of the second seat member 12 via the chin-shaped member 73*a*. However, an engagement portion 73*b* of a second edge of the spiral spring 73 is engaged with the first projection portion 11*a* and is connected to the first seat member 11.

Even if the spiral spring 73 is arranged in this manner, the valve rotation device 60 can chew the deposit between the valve seat 102 and the valve face 3*a* with the valve 1 being rotated, as well as the valve rotation device 10 of the first embodiment, the valve rotation device 20 and so on.

Eighth Embodiment

Next, a description will be given of valve rotation devices 80 and 81 with reference to FIG. 12A, FIG. 12B, FIG. 13A and FIG. 13B. FIG. 12A and FIG. 12B illustrate a part of the valve rotation device 80 in accordance with the eighth embodiment. FIG. 12A illustrates a valve-closed phase. FIG. 12B illustrates a valve-opened phase. FIG. 13A and FIG. 13B illustrate a part of the valve rotation device 81 in accordance with a modified embodiment of the eighth embodiment. FIG. 13A illustrates a valve-closed phase. FIG. 13B illustrates a valve-opened phase.

The valve rotation device 80 of the eighth embodiment is different from the valve rotation device 10 of the first embodiment, the valve rotation device 20 and so on in a point that a coil spring 83 is used instead of the spiral springs 13 and 73 acting as an elastic body.

A first edge of the coil spring 83 is attached to the second projection portion 22*a* extending from the second seat member 22. A second edge of the coil spring 83 is attached to an attachment portion 21*b* extending from the first seat member 21. Thereby, the coil spring 83 is arranged between the first seat member 21 and the second seat member 22. The coil spring 83 accumulates the elastic energy as well as the spiral springs 13 and 73 and can rotate the second seat member 22 with use of the elastic energy as the storing force. Thus, the valve rotation device 80 can chew the deposit between the valve seat 102 and the valve and so on face 3*a* with the valve 1 being rotated, as well as the valve rotation device 10 of the other embodiments.

The second edge of the coil spring 83 may be attached to an attachment portion 101*a*1 provided on a valve guide boss portion 101*a* as well as the valve rotation device 81 illustrated in FIG. 13A and FIG. 13B. The basic action of the valve rotation device 81 is common with other valve rotation devices. Therefore, a detailed explanation is omitted.

Ninth Embodiment

Next, a description will be given of a valve rotation device 90 in accordance with a ninth embodiment with reference to FIG. 14, FIG. 15A and FIG. 15B. FIG. 14 illustrates a surround of the valve 1 and the valve retainer 5 to which the valve rotation device 90 in accordance with the ninth embodiment is fixed. FIG. 15A and FIG. 15B illustrate a part of the valve rotation device 90 of the ninth embodiment. FIG. 15A illustrates the valve-closed phase. FIG. 15B illustrates the valve-opened phase.

The vale rotation devices of the first to eighth embodiments are arranged on the side of the cylinder head 101. In contrast, the valve rotation device 90 of the ninth embodiment is arranged on the valve retainer 5 side. A second seat member 92 is arranged on the valve retainer 5 side and rotates together with the valve retainer 5. A bottom board portion 91*b* included in the ring-shaped case member 91 is provided between the second seat member 92 and the valve spring 6.

In the following, a description will be given of details of the valve rotation device 90. The valve rotation device 90 has a ring-shaped case member 91 and the second seat member 92. The ring-shaped case member 91 has an inner sidewall portion 91*a*, the bottom board portion 91*b* and an outer sidewall portion 91*c*. An upper face of the ring-shaped case member 91 is opened. The second seat member 92 is mounted on the upper face side. The bottom board portion 91*b* of the ring-shaped case member 91 corresponds to the first seat member. The bottom board portion 91*b* is a member extending toward the surrounding of the valve stem 2 of the valve 1 under a condition that the rotation action of the bottom board portion 91*b* is suppressed with respect to the cylinder head 101. In concrete, the bottom board portion 91*b* is arranged so as to sandwich the valve spring 6 with the cylinder head 101. The rotation action of the bottom board portion 91*b* is suppressed with respect to the cylinder head 101. On the other hand, the second seat member 92 is capable of rotating with respect to the ring-shaped case member 91 and is in touch with the valve retainer 5. The valve spring 6 is in touch with the bottom board portion 91*b*. A first projection portion 91*b*1 extending toward inside of the ring-shaped case member 91 is provided on the bottom board portion 91*b*. The first projection portion 91*b*1 corresponds to the first projection portion 21*a* of the second embodiment. A second projection portion 92*a* extending toward inside of the ring-shaped case member 91 is provided in the second seat member 92. The second projection portion 92*a* corresponds to the second projection portion 22*a* of the second embodiment. The bent spring 23 is sandwiched between the first projection portion 91*b*1 and the second projection portion 92*a* as well as the second embodiment. The chin-shaped member 73*a* of the spiral spring 73 is in touch with the second projection portion 92*a*. The spiral spring 73 is in touch with the second seat member 92. The engagement portion 73*b* provided on the second edge of the spiral spring 73 is engaged with the first projection portion 91*b*1.

In the valve rotation device 90, when the load for opening the valve 1 is applied to the valve 1, the load is conducted to the second seat member 92 via the valve retainer 5. Thus, a distance between the second seat member 92 and the bottom board portion 91*b* is reduced. And, the bent spring 23 is compressed. As a result, the spiral spring 73 is pressed, and the elastic energy is accumulated by the spiral spring 73. When the phase of the valve 1 gets closer to the valve-closed phase, the storing force caused by the elastic energy accumulated by the spiral spring 73 rotates the second seat member 92. In this case, the valve retainer 5 rotates together with the second seat member 92 because of the friction force with the second seat member 92. As a result, the valve 1 integrated with the valve retainer 5 by the cotter 4 can rotate.

The valve rotation device 90 of the ninth embodiment can synchronize the timing of the rotation of the valve 1 with the timing of the closing of the valve 1 and can chew the deposit effectively as well as the other valve rotation devices.

The present invention is not limited to the specifically disclosed embodiments and variations but may include other embodiments and variations without departing from the scope of the present invention.

REFERENCE SIGNS LIST

1 valve
2 valve stem
3 valve head
3*a* valve face
4 cotter
5 valve retainer
6 valve spring
10, 20, 30, 40, 50, 60, 70, 80, 81, 90 valve rotation device
11, 21 first seat member
11*a*, 21*a* first projection portion
11*a*2 inclined face
12, 22 second seat member
12*a*, 22*a* second projection portion
13, 73 spiral spring (elastic body)
23, 33 bent spring
43 cam member
53 bent cam member
63 spherical member
83 coil spring
91 ring-shaped case member
91*a* inner sidewall member
91*b* bottom board member
91*b*1 first projection portion
100 internal combustion engine
101 cylinder head
101*a* valve guide boss portion
101*b* concave portion
102 valve seat

The invention claimed is:

1. A valve rotation device that rotates a valve fixed to an internal combustion engine, comprising:

a first seat member that extends toward a surrounding of a valve stem of the valve under a condition that a rotation action of the first seat member is suppressed with respect to a cylinder head of the internal combustion engine;

a second seat member that faces to the first seat member, rotates with respect to the first seat member and is subjected to a load for opening the valve;

a force conversion structure that converts the load for opening the valve applied to the second seat member into a rotation force in a direction around the valve stem of the second seat member; and an elastic body that accumulates an elastic energy when the valve is opened and the load for opening the valve rotates the second seat member via the force conversion structure, and rotates the second seat member by a storing force caused by the elastic energy when a phase of the valve gets closer to a valve-closed phase and the load for opening the valve is reduced, wherein the valve rotates together with the rotation of the second seat member;

the force conversion structure has a single first projection portion extending toward the second seat member from the first seat member and a single second projection portion extending toward the first seat member from the second seat; and the force conversion structure further forms an inclined face on at least one of the first projection portion and the second projection portion, brings the first projection portion into contact with the second projection portion along the inclined face so as to slide, rotates the second seat member with respect to the first seat member in accordance with a changing of an axial distance between the first seat member and the second seat member.

2. The valve rotation device as claimed in claim 1, wherein:

the first seat member is arranged on a cylinder head side of the internal combustion engine; and the second seat member is arranged between the first seat member and a valve spring and rotates together with the valve spring.

3. The valve rotation device as claimed in claim 1, wherein:

the second seat member is arranged on a valve retainer side and rotates together with a valve retainer; and the first seat member is arranged between the second seat member and a valve spring.

4. The valve rotation device as claimed in claim 1, further comprising a stopper portion that determines a maximum rotation amount of the second seat member that is rotated by the load for opening the valve via the force conversion structure.

5. The valve rotation device as claimed in claim 1, wherein the elastic body is a spiral spring or a coil spring, a first edge of the spiral spring being connected to the second seat member, a second edge of the spiral spring being connected to the first seat member or the cylinder head of the internal combustion engine, a first edge of the coil spring being connected to the second seat member, a second edge of the coil spring being connected to the first seat member or the cylinder head of the internal combustion engine.

6. A valve rotation device that rotates a valve fixed to an internal combustion engine, comprising:

a first seat member that extends toward a surrounding of a valve stem of the valve under a condition that a rotation action of the first seat member is suppressed with respect to a cylinder head of the internal combustion engine;

a second seat member that faces to the first seat member, rotates with respect to the first seat member and is subjected to a load for opening the valve;

a force conversion structure that converts the load for opening the valve applied to the second seat member into a rotation force in a direction around the valve stem of the second seat member;

an elastic body that accumulates an elastic energy when the valve is opened and the load for opening the valve rotates the second seat member via the force conversion structure, and rotates the second seat member by a storing force caused by the elastic energy when a phase of the valve gets closer to a valve-closed phase and the load for opening the valve is reduced, wherein the valve rotates together with the rotation of the second seat member, the force conversion structure, sandwiched between the first seat member and the second seat member, has a cam member with a length that varies in a direction along a circumference direction in accordance with a changing of an axial distance between the first seat member and the second seat member, and rotates the second seat member with respect to the first seat member in accordance with the varying length of the cam member; and the length of the cam member varies by rotating between the first seat member and the second seat member.

7. The valve rotation device as claimed in claim 6, wherein:

the first seat member is arranged on a cylinder head side of the internal combustion engine; and the second seat member is arranged between the first seat member and a valve spring and rotates together with the valve spring.

8. The valve rotation device as claimed in claim 6, wherein:

the second seat member is arranged on a valve retainer side and rotates together with a valve retainer; and the first seat member is arranged between the second seat member and a valve spring.

9. The valve rotation device as claimed in claim 6, further comprising a stopper portion that determines a maximum rotation amount of the second seat member that is rotated by the load for opening the valve via the force conversion structure.

10. The valve rotation device as claimed in claim 6, wherein the elastic body is a spiral spring or a coil spring, a first edge of the spiral spring being connected to the second seat member, a second edge of the spiral spring being connected to the first seat member or the cylinder head of the internal combustion engine, a first edge of the coil spring being connected to the second seat member, a second edge of the coil spring being connected to the first seat member or the cylinder head of the internal combustion engine.

* * * * *